US012599190B2

(12) United States Patent
Ruiz

(10) Patent No.: US 12,599,190 B2
(45) Date of Patent: Apr. 14, 2026

(54) HARD HAT FAN DEVICE

(71) Applicant: Anthony Ruiz, Knoxville, TN (US)

(72) Inventor: Anthony Ruiz, Knoxville, TN (US)

( * ) Notice: Subject to any disclaimer, the term of this patent is extended or adjusted under 35 U.S.C. 154(b) by 0 days.

(21) Appl. No.: 18/910,735

(22) Filed: Oct. 9, 2024

(65) Prior Publication Data

US 2025/0374989 A1 Dec. 11, 2025

Related U.S. Application Data

(60) Provisional application No. 63/658,461, filed on Jun. 11, 2024.

(51) Int. Cl.

| | |
|---|---|
| ***A42B 3/28*** | (2006.01) |
| ***A42B 3/14*** | (2006.01) |
| ***A42B 3/22*** | (2006.01) |

(52) U.S. Cl.

CPC ..... *A42B 3/286* (2013.01); *A42B 3/145* (2013.01); *A42B 3/227* (2013.01); *A42B 3/283* (2013.01)

(58) Field of Classification Search

CPC ..... A42B 3/286; A42B 3/145; A42B 3/227; A42B 3/283

See application file for complete search history.

(56) References Cited

U.S. PATENT DOCUMENTS

| | | | | |
|---|---|---|---|---|
| 3,041,621 | A * | 7/1962 | Brockway | A42B 3/14 2/419 |
| 3,548,415 | A | 12/1970 | Waters | |
| 4,672,968 | A * | 6/1987 | Lenox | A61B 90/00 607/109 |
| 5,577,495 | A * | 11/1996 | Murphy | A42B 3/225 128/201.24 |
| 6,081,929 | A * | 7/2000 | Rothrock | A42B 3/286 2/424 |
| 6,122,773 | A | 9/2000 | Katz | |
| 9,161,587 | B2 | 10/2015 | Green | |
| 9,241,529 | B1 | 1/2016 | Danelski | |
| 2011/0170280 | A1 * | 7/2011 | Soto | A42B 3/044 362/105 |
| 2013/0263364 | A1 * | 10/2013 | Green | A42B 3/286 2/422 |
| 2014/0359917 | A1 * | 12/2014 | Benson | A42B 3/286 2/171.3 |
| 2017/0332721 | A1 * | 11/2017 | Otey | A42B 3/227 |
| 2018/0064199 | A1 | 3/2018 | Battis | |
| 2021/0289874 | A1 | 9/2021 | Murphy | |
| 2022/0016450 | A1 * | 1/2022 | Hall | A42B 3/281 |

* cited by examiner

*Primary Examiner* — Khoa D Huynh
*Assistant Examiner* — Erick I Lopez
(74) *Attorney, Agent, or Firm* — Brennan, Manna & Diamond, LLC

(57) ABSTRACT

A hard hat fan device is disclosed, which is a modified fan that keeps users cool while wearing a full brim hard hat. The hard hat fan device comprises a fan component that includes two slim style fans attached to a back side of the helmet strap behind the head of the user and under the brim of the hat. The fan components are attached to a battery pack via USB cables with switches integrated in them for on and off usage. The battery pack is rechargeable and attached to the top of the hard hat on the back side via sticky hook and loop fastener patches. Further, the device comprises a halo ductwork that attaches to the fan components with mesh filters glued to the backside of each spinning fan. The halo ductwork runs all the way around the underside of the brim of the hat.

12 Claims, 3 Drawing Sheets

HARD HAT FAN DEVICE

CROSS-REFERENCE TO RELATED APPLICATION

The present application claims priority to, and the benefit of, U.S. Provisional Application No. 63/658,461, which was filed on Jun. 11, 2024, and is incorporated herein by reference in its entirety.

FIELD OF THE INVENTION

The present invention relates generally to the field of hard hat fan devices. More specifically, the present invention relates to a universal fan kit that can be attached to any type or size of full brim hard hat. Accordingly, the present disclosure makes specific reference thereto. Nonetheless, it is to be appreciated that aspects of the present invention are also equally applicable to other like applications, devices and methods of manufacture.

BACKGROUND

By way of background, this invention relates to improvements in hard hat fan devices. Generally, people who work in warm and humid conditions, especially with a hard hat and construction equipment, may lack the means to keep cool. Further, excessive sweating will inevitably occur and drip down the user's head and face. Constantly being forced to stop working because a person gets too warm can be frustrating. Additionally, work environments may lack shade or fans to keep people cool.

Hard hats have long been required by the U.S. Occupational Safety and Health Administration in industries that require employees to work in areas where there is a possible danger of head injury from impact, from falling or flying objects, or from electrical shock and burns. This means that employees working in these industries are usually required to wear a hard hat for most of their workday regardless of the weather conditions. Now the standard is hardened and reinforced plastic in order to reduce the weight that a person has to carry with the muscles of the neck. The duration that a person must wear a hard hat has only gotten longer due to the current legal conditions, further this longer wear causes excessive heat build-up during the warmer months. However, it has long been believed that the safety provided by a hard hat far outweighed the discomfort of extreme temperatures.

Accordingly, there is a demand for a hard hat fan device that allows users to keep their head cool enough to reduce excessive sweating, preventing overheating and dehydration. More particularly, there is a demand for a hard hat fan device that provides a universal fan that offers a way for people to keep their head cool while working in warm environments that lack considerable shade, air conditioning, and/or ventilation.

Therefore, there exists a long felt need in the art for a hard hat fan device that provides users with a universal fan that can be attached to any type or size of full brim hard hat. There is also a long felt need in the art for a hard hat fan device that allows users to keep their head cool enough to reduce excessive sweating, preventing overheating and dehydration. Further, there is a long felt need in the art for a hard hat fan device that features two slim fans positioned on the back side of the helmet, pointed at the wearer to keep his or her head cool. Moreover, there is a long felt need in the art for a device that utilizes a rechargeable USB battery pack to maintain power to the fans for daily wear. Further, there is a long felt need in the art for a hard hat fan device that offers a way for people to keep their head cool while working in warm environments that lack considerable shade, air conditioning, and/or ventilation. Finally, there is a long felt need in the art for a hard hat fan device that includes mesh filters that cover the fans during use.

The subject matter disclosed and claimed herein, in one embodiment thereof, comprises a hard hat fan device. The device is a modified fan that keeps users cool while wearing a full brim hard hat. The hard hat fan device comprises a fan component that includes two slim style fans attached to a back side of the helmet strap behind the head of the user and under the brim of the hat. The fan components are attached to a battery pack via USB cables with switches integrated in them for on and off usage. The battery pack is rechargeable and attached to the top of the hard hat on the back side via sticky hook and loop fastener patches. Further, the device comprises a halo ductwork that attaches to the fan components with mesh filters glued to the backside of each spinning fan. The halo ductwork runs all the way around the underside of the brim of the hat.

In this manner, the hard hat fan device of the present invention accomplishes all of the forgoing objectives and provides users with a device that provides a fan that is attached to any type of full brim hard hat. The device is composed of mostly ABS plastic. The device can comprise a filter of plastic, metal, or other lightweight material for the fan components.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a hard hat fan device. The device is a modified fan that keeps users cool while wearing a full brim hard hat. The hard hat fan device comprises a fan component that includes two slim style fans attached to the hard hat, under the brim of the hat. The fan components are attached to a battery pack. The battery pack is rechargeable and attached to the top of the hard hat. Further, the device comprises a halo ductwork that runs all the way around the underside of the brim of the hat and attaches to the fan components.

In one embodiment, hard hats may be used in a variety of construction jobs or other situations. Those wearing hard hats complete a wide range of tasks and physical labor. These tasks may be performed in confined spaces or outdoors, which includes hot and unventilated environments. However, such hard hats provide ineffective cooling, making the user uncomfortable and overheated while working and wearing the hard hat.

In one embodiment, the hard hat fan device is disclosed to be utilized namely in the context of a construction hard hat, however the hard hat fan device discussed herein is further applicable to other protective headwear, like a protective helmet. The conventional hard hat utilized with the device includes a shell with an outer surface, that includes a front outer surface, and a rear outer surface that opposes front outer surface. Further, the hard hat includes a bill or brim that extends outward from a lower circumference of the hard hat to shield the eyes of a user. Additionally, the hard hat comprises an interior cavity that is sized and shaped to fit a user's head and a suspension system and a helmet strap for adjustment/retention of the hard hat on a user's head.

In one embodiment, the hard hat fan device comprises a pair of fan components. Each fan component is a slim style fan that fits under the brim of the hard hat. The fan components can be any suitable size and shape as long as they are sized and shaped to fit under a hat brim during use. Typically, the fan component includes an elongated body extending along a longitudinal axis with a first end and a second end opposite the first end along the longitudinal axis. The elongated body is manufactured from a lightweight plastic material but not limited thereto. A fan and a motor are located at the first end, with the fan connected to the motor, and the motor is then connected to the battery pack via the USB cables. Further, each fan component includes an air intake and an air outlet or exhaust. Ambient air enters the fan component through the air intake and exits through air outlet. Specifically, the ambient air is drawn into the fan component through the air intake, and then the fan being actuated by a switch, blows the (cooling) air through the air outlet into the interior of the hard hat. A pair of fan components are utilized with the device, such that one fan component is positioned on either side of the hat brim and attached to a back side of the helmet strap, behind the head of a user and under the brim of the hard hat. In position, the fan components are pointed at the user, so that the fan blows air onto a user's lower face, neck, shoulders, and upper body, to keep his or her head and upper body cool while wearing the hard hat. Thus, the fan components remove hot/humid air from between the head of a user and hard hat.

In one embodiment, the fan components each comprise a mesh filter which is secured to a backside of each fan component, to cover the spinning fan. The mesh filters are typically glued to the housing of the spinning fan but can be secured via any suitable securing means as is known in the art. Further, the mesh filters are made of plastic and can be replaced with metal or any other suitable lightweight material.

In one embodiment, the fan components are secured within the hard hat via a halo ductwork that attaches to the fan components. The halo ductwork runs all the way around the underside of the hat brim. The halo ductwork is secured to the hat brim via adhesives, glueing, screws, etc., or any other suitable securing means as is known in the art. Typically, the halo ductwork is made of a PLA filament but can be made of ABS or any other lightweight material to facilitate airflow direction of the fan components. The halo ductwork limits/prevents accidental jarring or removal of the fan components during use. Thus, in this configuration, the halo ductwork securely locks the fan components onto the hard hat and allows the fan components to adjust to a variety of user movements while wearing the hard hat. A user may disconnect and remove the fan components by moving and/or removing the halo ductwork from the hard hat.

In one embodiment, the fan components and motors are powered by a rechargeable battery pack (i.e., one or more battery cells). The battery pack is mounted and secured to a top of the hard hat, on the back side. In this position, the battery pack does not interfere with the movement of the head of a user while wearing the hard hat. Typically, the battery pack is releasably mounted via sticky hook and loop fastener patches, but can be secured via any suitable securing means (releasable or not), as is known in the art, such as glue, adhesives, screws, etc. The battery pack is located on the back side of the hard hat and provides a counterbalance for the weight added by the fan components and motors.

In one embodiment, the fan components are connected to the battery pack via USB cables with hermetically sealed integrated switches that allow the fan components to be turned on and off, as needed, or can be connected to the battery pack via any other suitable connecting means as is known in the art. Further, the battery pack is a lithium-ion pack which allows the battery pack to be rechargeable via a USB cable. Accordingly, the battery pack is rechargeable and interchangeable to accommodate daily wear and use. Thus, the battery pack maintains power to the fan components for daily wear without worry of interruption.

In one embodiment, the fan components are mounted onto the hard hat via a mounting bracket that allows the fan components to be pivotable in and out. Specifically, the fan components are securely and removably coupled to the mounting bracket. Further, the mounting bracket allows the fan components to be arranged in different configurations and/or at different angles based on a user's need. Typically, the fan components are secured to the mounting bracket via different types and lengths of fasteners or other securing means.

In one embodiment, the hard hat fan device and its components are all hermetically sealed and waterproof to prevent any damage from weather or sweat, etc.

In operation, the hard hat fan device is configured to provide fluid communication for air between an exterior of the hard hat and the interior region of the hard hat in order to provide a cooling sensation to a user when the user's head is positioned within the interior region of the hard hat. Specifically, air flows from the air intake of the fan component through the air outlet of the fan component. Accordingly, the fan component provides improved air movement and heat/moisture transfer away from a user's head and upper body.

In one embodiment, the hard hat fan device is manufactured from a durable, lightweight plastic, or other suitable materials as is known in the art, or a combination of such materials.

In yet another embodiment, the hard hat fan device comprises a plurality of indicia.

In yet another embodiment, a method of cooling a hard hat user, while wearing the hard hat is disclosed. The method includes the steps of providing a hard hat fan device comprising fan components secured to a battery pack. The method also comprises positioning halo ductwork around an underside of the hat brim. Further, the method comprises securing fan components on either side of the hard hat and under the hat brim. The method also comprises securing a battery pack to the back of the hard hat. The method also comprises connecting the battery pack to the fan components. Finally, the method comprises utilizing the fan components to cool the user while wearing the hard hat.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
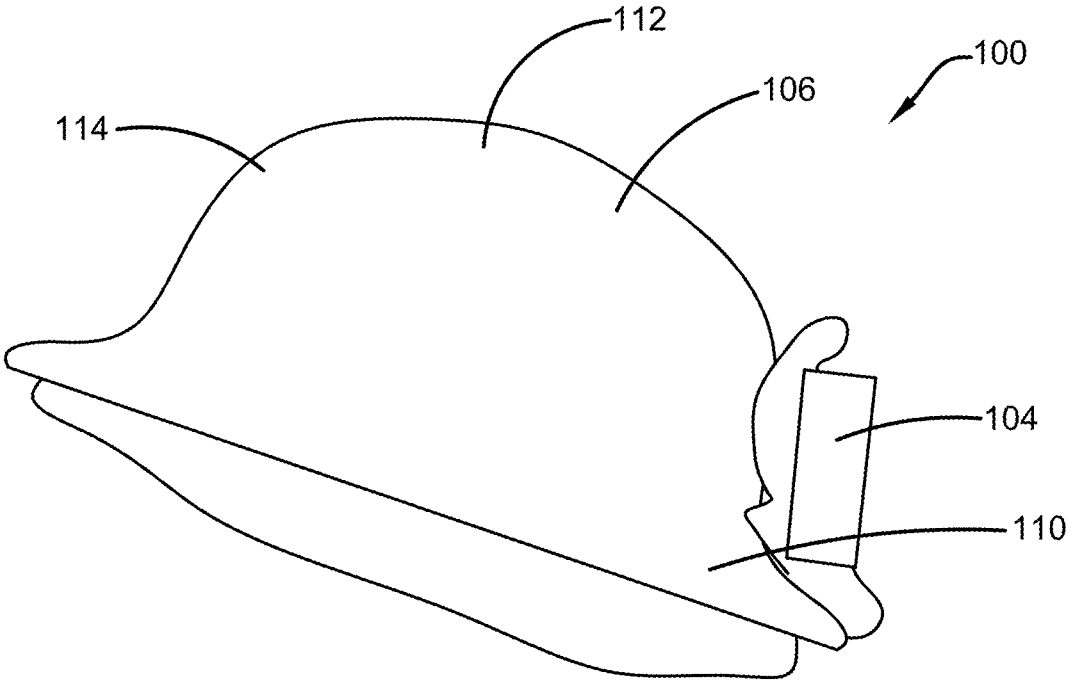
FIG. 1 illustrates a perspective view of one embodiment of the hard hat fan device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a hard hat fan device that provides users with a universal fan that can be attached to any type or size of full brim hard hat. There is also a long felt need in the art for a hard hat fan device that allows users to keep their head cool enough to reduce excessive sweating, preventing overheating and dehydration. Further, there is a long felt need in the art for a hard hat fan device that features two slim fans positioned on the back side of the helmet, pointed at the wearer to keep his or her head cool. Moreover, there is a long felt need in the art for a device that utilizes a rechargeable USB battery pack to maintain power to the fans for daily wear. Further, there is a long felt need in the art for a hard hat fan device that offers a way for people to keep their head cool while working in warm environments that lack considerable shade, air conditioning, and/or ventilation. Finally, there is a long felt need in the art for a hard hat fan device that includes mesh filters that cover the fans during use.

The present invention, in one exemplary embodiment, is a novel hard hat fan device. The hard hat fan device comprises a fan component that includes two slim style fans attached to a back side of the helmet strap behind the head of the user and under the brim of the hat. The fan components are attached to a battery pack via USB cables with switches integrated in them for on and off usage. The battery pack is rechargeable and attached to the top of the hard hat on the back side via sticky hook and loop fastener patches. Further, the device comprises a halo ductwork that attaches to the fan components with mesh filters glued to the backside of each spinning fan. The halo ductwork runs all the way around the underside of the brim of the hat. The present invention also includes a novel method of cooling a hard hat user, while wearing the hard hat. The method includes the steps of providing a hard hat fan device comprising fan components secured to a battery pack. The method also comprises positioning halo ductwork around an underside of the hat brim. Further, the method comprises securing fan components on either side of the hard hat and under the hat brim. The method also comprises securing a battery pack to the back of the hard hat. The method also comprises connecting the battery pack to the fan components. Finally, the method comprises utilizing the fan components to cool the user while wearing the hard hat.

Referring initially to the drawings, FIG. 1 illustrates a perspective view of one embodiment of the hard hat fan device 100 of the present invention. In the present embodiment, the hard hat fan device 100 is an improved hard hat fan device 100 that provides a user with a modified fan that keeps users cool while wearing a hard hat 106. Specifically, the hard hat fan device 100 comprises a pair of fan components 102 and an attached battery pack 104. The battery pack 104 is rechargeable and attached to the top of the hard hat 106. Further, the device 100 comprises a halo ductwork 108 that runs all the way around the underside of the brim 110 of the hat 106 and attaches to the fan components 102.

Generally, hard hats 106 may be used in a variety of construction jobs or other situations. Those wearing hard hats 106 complete a wide range of tasks and physical labor. These tasks may be performed in confined spaces or outdoors, which includes hot and unventilated environments. However, such hard hats 106 provide ineffective cooling, making the user uncomfortable and overheated while working and wearing the hard hat 106.

Further, the hard hat fan device 100 is disclosed to be utilized namely in the context of a construction hard hat 106, however the hard hat fan device 100 discussed herein is further applicable to other protective headwear, like a protective helmet. The conventional hard hat 106 utilized with the device 100 includes a shell with an outer surface 112, that includes a front outer surface 114, and a rear outer surface 116 that opposes front outer surface 114. Further, the hard hat 106 includes a bill or brim 110 that extends outward from a lower circumference of the hard hat 106 to shield the eyes of a user. Additionally, the hard hat 106 comprises an interior cavity 118 that is sized and shaped to fit a user's head and a suspension system and a helmet strap 120 for adjustment/retention of the hard hat 106 on a user's head.

Figure 2:
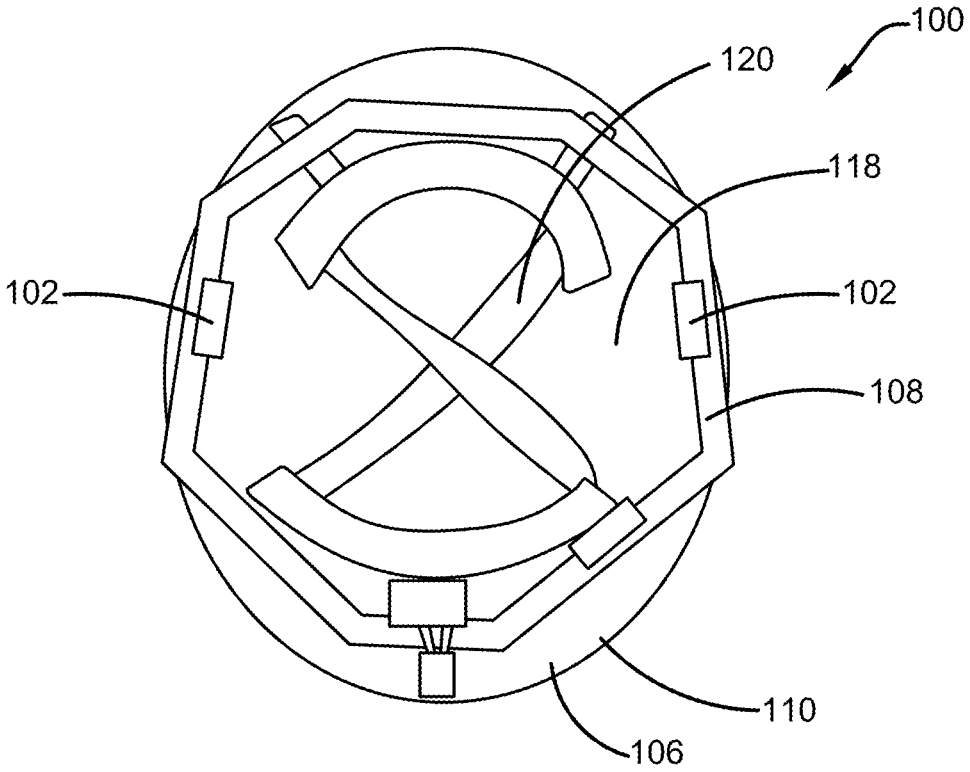
FIG. 2 illustrates a perspective view of one embodiment of the hard hat fan device of the present invention showing the internal halo ductwork in accordance with the disclosed architecture.

As shown in FIG. 2, the fan components 102 are secured within the hard hat 106 via a halo ductwork 108 that attaches to the fan components 102. The halo ductwork 108 runs all the way around the underside of the hat brim 110. The halo ductwork 108 is secured to the hat brim 110 via adhesives, glueing, screws, etc., or any other suitable securing means as is known in the art. Typically, the halo ductwork 108 is made of a PLA filament but can be made of ABS or any other lightweight material to facilitate airflow direction of the fan components 102. The halo ductwork 108 limits/prevents accidental jarring or removal of the fan components 102 during use. Thus, in this configuration, the halo ductwork 108 securely locks the fan components 102 onto the hard hat 106 and allows the fan components 102 to adjust to a variety of user movements while wearing the hard hat 106. A user may disconnect and remove the fan components 102 by moving and/or removing the halo ductwork 108 from the hard hat 106.

Figure 3:
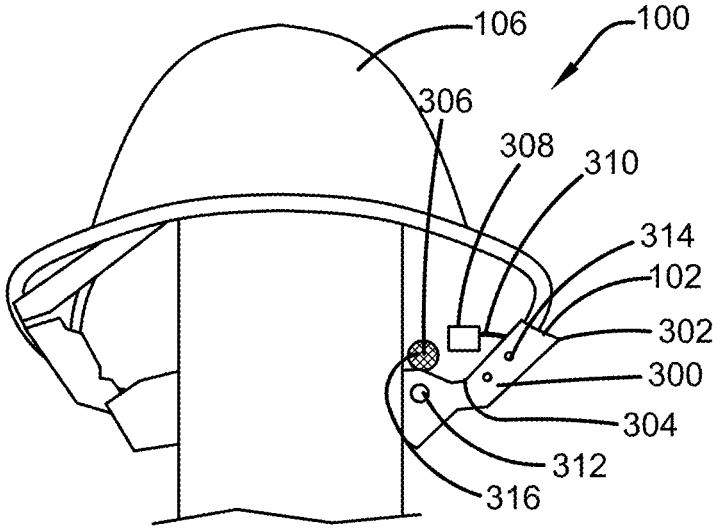
FIG. 3 illustrates a perspective view of one embodiment of the hard hat fan device of the present invention showing the fan components in accordance with the disclosed architecture.

As shown in FIG. 3, the hard hat fan device 100 comprises a pair of fan components 102. Each fan component 102 is a slim style fan that fits under the brim 110 of the hard hat 106. The fan components 102 can be any suitable size and shape as long as they are sized and shaped to fit under a hat brim 110 during use. Typically, the fan component 102 includes an elongated body 300 extending along a longitudinal axis with a first end 302 and a second end 304 opposite the first end 302 along the longitudinal axis. The elongated body 300 is manufactured from a lightweight plastic material but not limited thereto. A fan 306 and a motor 308 are located at the first end 302, with the fan 306 connected to the motor 308, and the motor 308 is then connected to the battery pack 104 via the USB cables 310. Further, each fan component 102 includes an air intake 312 and an air outlet 314 or exhaust. Ambient air enters the fan component 102 through the air intake 312 and exits through air outlet 314. Specifically, the ambient air is drawn into the fan component 102 through the air intake 312, and then the fan 306 being actuated by a switch, blows the (cooling) air through the air outlet 314 into the interior of the hard hat 106. A pair of fan components 102 are utilized with the device 100, such that one fan component 102 is positioned on either side of the hat brim 110 and attached to a back side of the helmet strap 120, behind the head of a user and under the brim 110 of the hard hat 106. In position, the fan components 102 are pointed at the user, so that the fan 306 blows air onto a user's lower face, neck, shoulders, and upper body, to keep his or her head and upper body cool while wearing the hard hat 106. Thus, the fan components remove hot/humid air from between the head of a user and hard hat.

Further, the fan components 102 each comprise a mesh filter 316 which is secured to a backside of each fan component 102, to cover the spinning fan 306. The mesh filters 316 are typically glued to the housing 300 of the spinning fan 306 but can be secured via any suitable securing means as is known in the art. Further, the mesh filters 316 are made of plastic and can be replaced with metal or any other suitable lightweight material.

Figure 4:
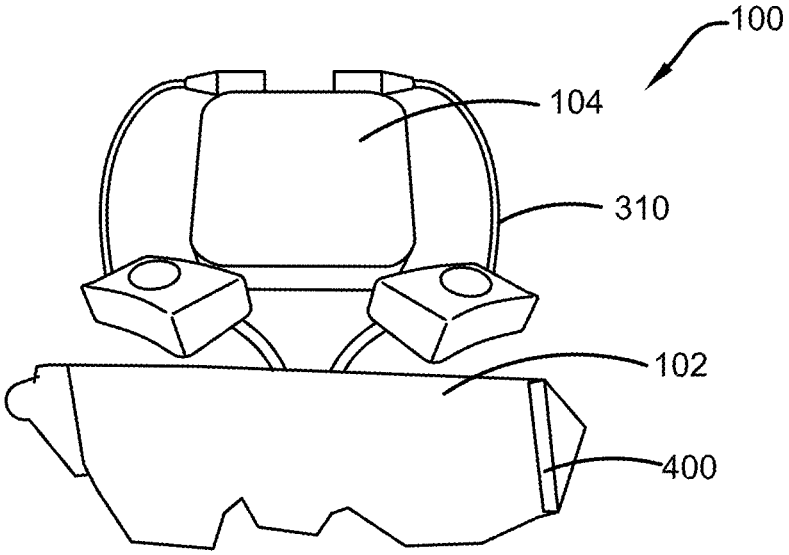
FIG. 4 illustrates a perspective view of one embodiment of the hard hat fan device of the present invention showing the battery pack attached to the fan components in accordance with the disclosed architecture.

As shown in FIG. 4, the fan components 102 and motors 308 are powered by a rechargeable battery pack 104 (i.e., one or more battery cells). The battery pack 104 is mounted and secured to a top of the hard hat 106, on the back side. In this position, the battery pack 104 does not interfere with the movement of the head of a user while wearing the hard hat 106. Typically, the battery pack 104 is releasably mounted via sticky hook and loop fastener patches, but can be secured via any suitable securing means (releasable or not), as is known in the art, such as glue, adhesives, screws, etc. The battery pack 104 is located on the back side of the hard hat 106 and provides a counterbalance for the weight added by the fan components 102 and motors 308.

Further, the fan components 102 are connected to the battery pack 104 via USB cables 310 with hermetically scaled integrated switches that allow the fan components 102 to be turned on and off, as needed, or can be connected to the battery pack 104 via any other suitable connecting means as is known in the art. Further, the battery pack 104 is a lithium-ion pack which allows the battery pack 104 to be rechargeable via a USB cable 310. Accordingly, the battery pack 104 is rechargeable and interchangeable to accommodate daily wear and use. Thus, the battery pack 104 maintains power to the fan components 102 for daily wear without worry of interruption.

Additionally, the fan components 102 are mounted onto the hard hat 106 via a mounting bracket 400 that allows the fan components 102 to be pivotable in and out. Specifically, the fan components 102 are securely and removably coupled to the mounting bracket 400. Further, the mounting bracket 400 allows the fan components 102 to be arranged in different configurations and/or at different angles based on a user's need. Typically, the fan components 102 are secured to the mounting bracket 400 via different types and lengths of fasteners or other securing means.

Figure 5:
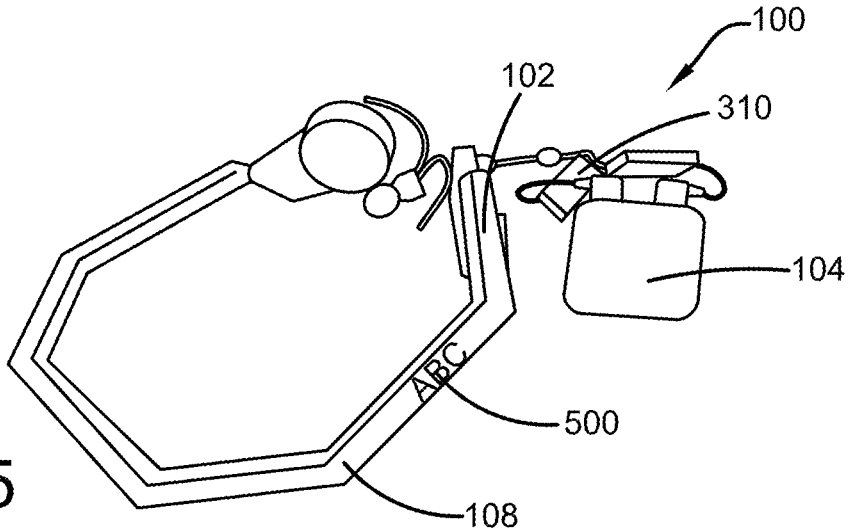
FIG. 5 illustrates a perspective view of one embodiment of the hard hat fan device of the present invention showing all components of the device in accordance with the disclosed architecture.

As shown in FIG. 5, the hard hat fan device 100 and its components are all hermetically sealed and waterproof to prevent any damage from weather or sweat, etc.

In operation, the hard hat fan device 100 is configured to provide fluid communication for air between an exterior of the hard hat 106 and the interior region of the hard hat 106 in order to provide a cooling sensation to a user when the user's head is positioned within the interior region 118 of the hard hat 106. Specifically, air flows from the air intake 312 of the fan component 102 through the air outlet 314 of the fan component 102. Accordingly, the fan component 102 provides improved air movement and heat/moisture transfer away from a user's head and upper body.

In one embodiment, the hard hat fan device 100 is manufactured from a durable, lightweight plastic, or other suitable materials as is known in the art, or a combination of such materials. Specifically, the device 100 can be manufactured from heat-scalable plastic or polymers, such as polypropylene or acrylonitrile-butadiene-styrene (ABS), or any other suitable material as is known in the art, such as but not limited to, acrylic, polycarbonate, polyethylene, polyethylene terephthalate, polyvinyl chloride, polystyrene, etc. Generally, the hard hat fan device 100 is also manufactured from a material that is water resistant or waterproof, or comprises a coating that is water resistant or waterproof.

In yet another embodiment, the hard hat fan device 100 comprises a plurality of indicia 500. The fan components 102 of the device 100 may include advertising, a trademark, or other letters, designs, or characters, printed, painted, stamped, or integrated into the fan components 102, or any other indicia 500 as is known in the art. Specifically, any suitable indicia 500 as is known in the art can be included, such as but not limited to, patterns, logos, emblems, images, symbols, designs, letters, words, characters, animals, advertisements, brands, etc., that may or may not be fan, hard hat, or brand related.

Figure 6:
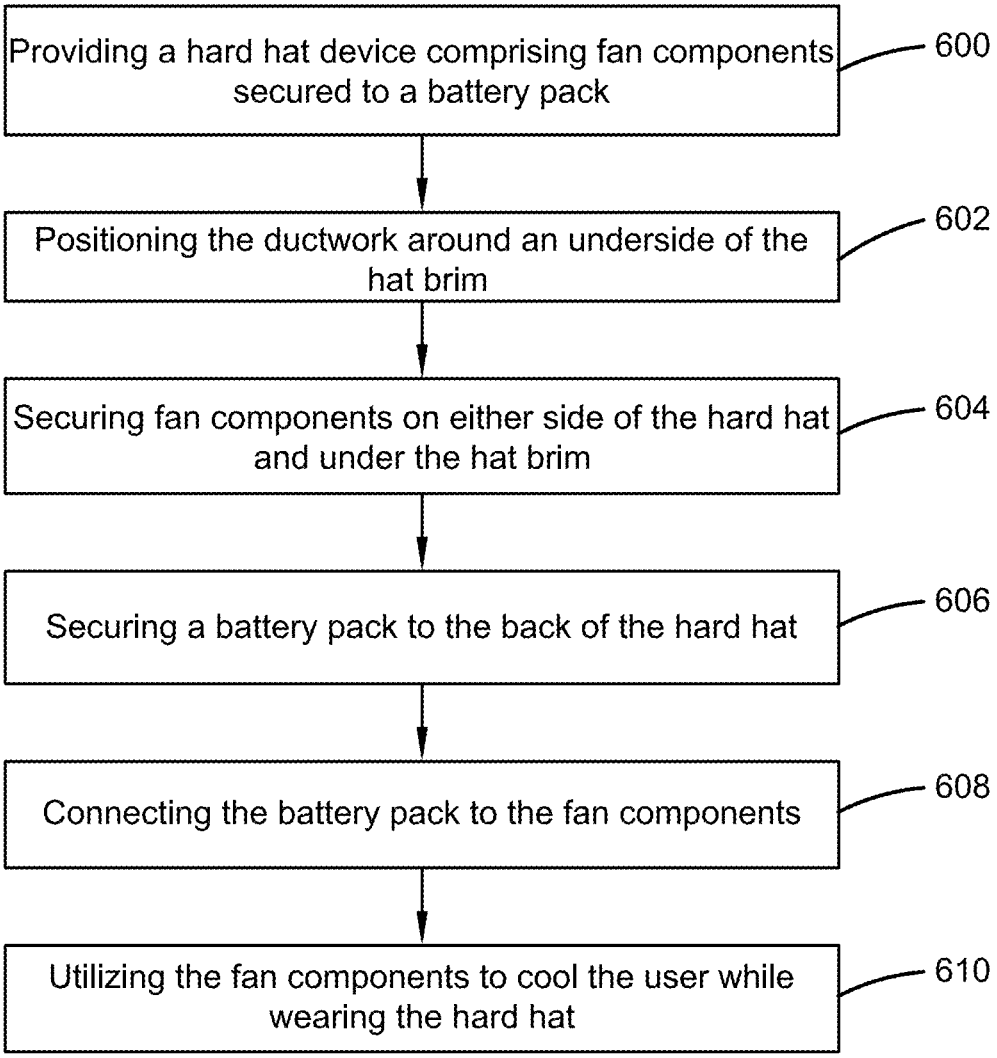
FIG. 6 illustrates a flowchart showing the method of cooling a hard hat user, while wearing the hard hat in accordance with the disclosed architecture.

FIG. 6 illustrates a flowchart of the method of cooling a hard hat user, while wearing the hard hat. The method includes the steps of at 600, providing a hard hat fan device comprising fan components secured to a battery pack. The method also comprises at 602, positioning halo ductwork around an underside of the hat brim. Further, the method comprises at 604, securing fan components on either side of the hard hat and under the hat brim. The method also comprises at 606, securing a battery pack to the back of the hard hat. The method also comprises at 608, connecting the battery pack to the fan components. Finally, the method comprises at 610, utilizing the fan components to cool the user while wearing the hard hat.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "hard hat fan device", "hard hat device", "fan device", and "device" are interchangeable and refer to the hard hat fan device 100 of the present invention.

Notwithstanding the forgoing, the hard hat fan device 100 of the present invention can be of any suitable size and configuration as is known in the art without affecting the overall concept of the invention, provided that it accomplishes the above stated objectives. One of ordinary skill in the art will appreciate that the hard hat fan device 100 as shown in FIGS. 1-6 is for illustrative purposes only, and that many other sizes and shapes of the hard hat fan device 100 are well within the scope of the present disclosure. Although the dimensions of the hard hat fan device 100 are important design parameters for user convenience, the hard hat fan device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A hard hat fan device comprising:

a pair of fan components; and a battery pack;

wherein the pair of fan components are secured, one on either side of a hard hat;

wherein the pair of fan components are attached to the battery pack;

wherein the battery pack is releasably attachable to a back of the hard hat; and wherein the pair of fan components are configured to act to keep users cool while wearing the hard hat;

wherein each of the pair of fan components comprises a mesh filter glued to a housing of the respective fan component;

wherein the pair of fan components are secured within the hard hat via a polylactic acid (PLA) filament halo ductwork; and further wherein the battery pack is connected to each of the pair of fan components via a hermetically sealed integrated switch USB cable.

2. The hard hat fan device of claim 1, wherein the hard hat includes an outer surface, that includes a front outer surface, and a rear outer surface, with a brim that extends outward from a lower circumference of the hard hat and is configured to shield eyes of a user.

3. The hard hat fan device of claim 2, wherein the hard hat comprises an interior cavity sized and shaped to fit a user's head and a suspension system and a helmet strap for adjustment/retention of the hard hat on a user's head.

4. The hard hat fan device of claim 1, wherein the halo ductwork runs all the way around an underside of the hat brim.

5. The hard hat fan device of claim 1, wherein each of the pair of fan components is a slim style fan that fits under the brim of the hard hat.

6. The hard hat fan device of claim 5, wherein the pair of fan components each include an elongated body extending along a longitudinal axis with a first end and a second end, a fan and a motor are located at the first end, with the fan connected to the motor, and the motor is connected to the battery pack.

7. The hard hat fan device of claim 6, wherein each fan component includes an air intake and an air outlet, such that ambient air enters each fan component through the air intake and exits through the air outlet.

8. The hard hat fan device of claim 1, wherein the battery pack is a lithium-ion pack which allows the battery pack to be rechargeable via a USB cable.

9. A hard hat fan device comprising:

a pair of fan components each comprising a mesh filter glued to a housing of the respective fan component; and a battery pack connected via USB cables to the pair of fan components;

wherein the hard hat includes an outer surface, a brim that extends outward from a lower circumference of the hard hat, an interior cavity configured to be sized and shaped to fit a user's head and a suspension system and a helmet strap for adjustment/retention of the hard hat on a user's head;

wherein each of the pair of fan components is a slim style fan that fits under the brim of the hard hat on either side;

wherein the pair of fan components each include an elongated body extending along a longitudinal axis with a first end and a second end, a fan and a motor are located at the first end, with the fan connected to the motor, and the motor is then connected to the battery pack;

wherein each of the pair of fan component includes an air intake and an air outlet, such that ambient air enters each of the pair of fan components through the air intake and exits through air outlet;

wherein the pair of fan components are secured within the hard hat via a halo ductwork, which runs all the way around an underside of the hat brim;

wherein the battery pack is hook and loop releasably attachable to a back of the hard hat and is a lithium-ion pack which allows the battery pack to be rechargeable via a USB cable;

wherein the pair of fan components are configured to act to keep users cool while wearing the hard hat; and wherein the pair of fan components are mounted onto the hard hat via a mounting bracket that allows the pair of fan components to be pivotable in and out; and wherein each of the pair of fan components further comprises an integrated indicia.

10. The hard hat fan device of claim 9, wherein the halo ductwork is configured to limit and prevent accidental jarring or removal of the pair of fan components during use.

11. The hard hat fan device of claim 10, wherein the halo ductwork securely locks the pair of fan components onto the hard hat and allows the pair of fan components to adjust to a variety of user movements while wearing the hard hat.

12. The hard hat fan device of claim 9, wherein the hard hat fan device is manufactured from a durable, lightweight plastic.

* * * * *